US005307607A

United States Patent [19]

Tondo

[11] Patent Number: 5,307,607

[45] Date of Patent: May 3, 1994

[54] APPARATUS FOR COMPACTING TRASH OR THE LIKE

[76] Inventor: Frank Tondo, 19 Grey Ave., Allendale, N.J. 07401

[21] Appl. No.: 959,916

[22] Filed: Oct. 13, 1992

[51] Int. Cl.[5] ..... B65B 1/24

[52] U.S. Cl. ..... 53/438; 53/529; 100/233

[58] Field of Search ..... 53/438, 439, 436, 529, 53/527, 523, 530; 100/233, 250, 228

[56] References Cited

U.S. PATENT DOCUMENTS

| | | | |
|---|---|---|---|
| 561,133 | 6/1896 | Roop et al. . | |
| 3,288,177 | 11/1966 | Clark | 141/73 |
| 3,424,078 | 1/1969 | Boyd et al. | 100/99 |
| 3,438,321 | 4/1969 | Gladwin . | |
| 3,495,376 | 2/1970 | Lundgren . | |
| 3,518,771 | 5/1970 | Felts | 100/218 |
| 3,554,117 | 1/1971 | Goldkuhle | 100/218 |
| 3,554,120 | 1/1971 | Liberman et al. | 100/233 X |
| 3,561,352 | 2/1971 | Hirsch | 100/233 X |
| 3,589,277 | 6/1971 | Gray | 100/215 |
| 3,608,478 | 9/1971 | Hoffman | 100/209 |
| 3,621,774 | 11/1971 | Dedio et al. | 100/179 |
| 3,621,775 | 11/1971 | Dedio et al. | 100/215 |
| 3,638,561 | 2/1972 | Price et al. | 100/215 |
| 3,734,006 | 5/1973 | Hennells | 100/215 X |
| 3,741,107 | 6/1973 | Boyd et al. | 100/215 |
| 3,752,059 | 8/1973 | Boyer | 100/218 |
| 3,808,967 | 5/1974 | Fair et al. | 100/221 |
| 3,822,638 | 7/1974 | Merkin | 100/215 |
| 3,863,561 | 2/1975 | Karls | 100/215 X |
| 3,872,784 | 3/1975 | Kaszuba et al. | 100/215 X |
| 3,885,467 | 5/1975 | Merkin | 100/215 |
| 3,908,538 | 9/1975 | Boyd | 53/529 X |
| 3,961,573 | 6/1976 | Schmidt | 100/100 |
| 4,002,004 | 1/1977 | Lambert | 53/438 X |
| 4,070,962 | 1/1978 | Peterson | 100/209 |
| 4,099,363 | 7/1978 | Wistinghausen et al. | 53/529 |
| 4,213,384 | 7/1980 | Telling | 100/74 |
| 4,458,588 | 7/1984 | Steele | 100/100 |
| 4,594,942 | 6/1986 | Denneboom | 100/233 X |
| 4,757,758 | 7/1988 | Tondo | 100/245 |
| 4,996,918 | 3/1991 | Carter et al. | 100/221 X |
| 5,119,722 | 6/1992 | Carter et al. | 100/221 |
| 5,123,339 | 6/1992 | Hetherington | 100/233 |
| 5,129,318 | 7/1992 | Zimmer | 100/221 |
| 5,181,463 | 1/1993 | Lackner | 100/137 |

OTHER PUBLICATIONS

Brochure for "Model NYC-200" compactor, Arrow Steel Inc., Patterson, N.J.

Brochure for "Econo-Pak" compactor, Waterbury Hydraulic & Pollution Sciences, Inc., Waterbury, Conn.

Brochure for "HIVOLEX-J" compactor, Lifestyle Systems, Inc., Floral Park, N.Y.

Brochure for "APT-25" compactor, Union Environmental Division, Union Corporation, Old Forge, Pa.

Brochure for "Cleanpacker" compactor with linear conveyor, Model #242011-B, Econetics, Inc., New York, N.Y.

Brochure for "Cleanpacker" compactor with container, Model #242011-C, Econetics, Inc., New York, N.Y.

Brochure for "Cleanpacker" compactor, with turntable, Model #242011-B, Stye T, Econetics, Inc., New York, N.Y.

Brochure for multiple plastic bag cartridge, JAD Corp., College Point, N.Y.

*Primary Examiner*—James F. Coan

*Attorney, Agent, or Firm*—Banner, Birch, McKie & Beckett

[57] ABSTRACT

A trash compactor having a single inlet and multiple parallel outlets a single ram mechanism for servicing all of the outlets. a semi-circular ram chamber and a pie-shaped ram which is connected to the ram chamber at the center of the semi-circular diameter. The outlets are disposed on either side of the center point so that when the ram is moved in a pivotal compacting motion the material is pushed out the outlets into rigid containers, bags or the like. The ram driving mechanism can be a yoke and parallel piston-cylinder mechanism, a gear rack and spur gear or pinion driven by a pair of piston-cylinders or a gear reduction motor whose output shaft is connected to the ram to provide the compacting motion. A sensing device such as a photo-electric eye can be placed in the compactor with its beam traversing the inside of the body. When the beam of the photoeye is interrupted by incoming trash from the inlet, a normally open switch is closed and the ram is moved either to the left or right to compact the trash in the ram chamber.

39 Claims, 12 Drawing Sheets

APPARATUS FOR COMPACTING TRASH OR THE LIKE

FIELD OF THE INVENTION

The present invention pertains to large scale compacting machines for reducing the volume of solid trash and waste for commercial, industrial and residential applications.

BACKGROUND OF THE INVENTION

In large buildings such as apartments, office buildings and the like, it has been the practice to provide large capacity trash compacting devices to reduce the volume of, and thus permit easier handling for removal thereof Examples of these devices are the "Econo-Pak" available from Waterbury Hydraulic & Pollution Sciences of Waterbury, Conn.; the "Cleanpacker" Multiple Bag—Turntable Compactor (Model No. 242011-B Style T), Multiple Bag—Linear Conveyor Compactor (Model No. 242011-B), and Container Compactor (Model No. 242011-C), each available from Econetics, Inc. of New York, N.Y.; the "APT-25" compactor available from the Union Environmental Division of Union Corporation of Old Forge, Pa.; and the "Hivolex-J" compactor available from Lifestyle Systems, Inc. of Floral Park, N.Y. Another example of a prior device is Arrow Steel's "Model 200" compactor available from Arrow Steel, Inc. Of Patterson, N.J. Further examples of known trash compactors are shown in U.S. Pat. Nos. 3,734,006 to Hennells; 3,621,775 to Dedio et al. and 3,872,784 to Kaszuba et al. These patents and any other patents or publications mentioned anywhere in this disclosure are hereby incorporated by reference in their entireties.

A plurality of single compactors may be used to handle large volumes of trash but purchasing many single compactors is relatively expensive. Other disadvantages thereof are the requirement of frequent attention of an operator since each machine requires individual attention when full or jammed, inefficient use of available floor space, large bales of compacted trash requiring special equipment such as hoisting or propelling mechanisms to them, and unproductive idle time due to the need for frequent emptying and replacement of filled containers. Examples of single compactors are the above-mentioned "Model 200" from Arrow Steel, and those of the Hennells and Dedio et al patents. Dual-acting compactors which have been used are essentially a pair of single compactors assembled together in a single housing, and having separate compacting mechanisms for each outlet or container. An example of a dual-acting compactor is the above-mentioned Kaszuba et al. patent. Compacting rams used in previous devices are mostly of the reciprocating piston-cylinder type in which the trash is compacted by a compacting head at an end of the piston in a linear fashion along the same longitudinal axis as the operation of the piston-cylinder. In operation, reciprocating rams only compact the trash in one direction that is, compaction occurs only during piston extension. Such linear rams require the use of a separate such mechanism for each outlet or container. Due to the use of individual mechanisms, the machines are not simplified in any substantial way.

SUMMARY OF THE INVENTION

A compactor for large scale use which has a single inlet and compacting mechanism and multiple outlets each feeding into trash containers or dumpsters or bagging cartridges is herein disclosed. The present invention is designed to overcome the disadvantages in the prior art of frequently changing or monitoring the containers, of the added complexity and expense of a compacting mechanism for each outlet or container and of inefficient use of floor space in a trash room or similar location.

The present invention employs a single compactor apparatus with a single inlet and with multiple outlets which are arranged in a parallel relationship to each other so as to occupy minimum space. The apparatus includes a hopper in through which trash is deposited from a trash chute from above, a semi-circular compacting chamber having a pie-shaped ram which pivots about a pivot point to push trash through outlets on opposite sides of the pivot point. The ram of this compactor apparatus makes contact with the trash in an arcuate path, thereby allowing for multiple outlets or containers to be serviced with only one ram mechanism. In contrast to the reciprocating rams of most previous compactors, movement of the ram of the present invention in its arcuate path compacts trash in both directions. In other words, each pivot of the ram is able to compact the trash which can be on either side of the ram. The ram of the present invention thereby uses the energy to drive the ram more efficiently than prior devices which only compact in one direction. Thus, the compactor is substantially simplified and the operational and manufacturing expenses are reduced. Moreover, since the pivoting motion of the ram pushes the trash alternately through each of the outlets, more than one container can be filled through the action of only one compactor mechanism requiring less operator attention than with previous compactors.

The ram of this invention can be driven by any number of suitable means. The preferred embodiments alternatively include (1) parallel hydraulic piston-cylinders with a yoke, (2) a rack and pinion gear arrangement with the rack driven by a pair of aligned hydraulic piston-cylinders, and (3) a gear reduction motor with its output shaft driving the ram shaft. Although these are the preferred driving means, use of any suitable driver for the pie-shaped ram as would be apparent to those skilled in the art is within the scope of the present invention.

The present invention can be adapted for use with existing trash containers and bagging devices. Preferred containers include standard two-yard waste containers or dumpsters which can be lifted and emptied using existing mechanisms on garbage trucks. The outlets of the compactor are positioned to align with the openings of the dumpsters so that trash can be pushed directly into the containers from the outlets. Another way to dispose of waste is to use bag cartridges, which are bundles of plastic bags which are placed on the outlets to receive the trash from the compactor. The use of bag cartridges is known in the art, and the present invention can use known bagging procedures. In short, the bags are separated as they are filled and desposited on roller conveyors to move them away from the compactor. A variety of bagging cartridges and accessories are available such as the bag refuse cartridges sold by the JAD Corporation of College Point, N.Y.

Although the present disclosure relates to the use of compactors for waste disposal, other applications in which the volume of relatively loose material is to be reduced or compacted are contemplated, such as baling or packing operations for raw cotton or insulation. In other words, the apparatus of the present invention can be used for other packing or compacting operations other than waste disposal.

Advantages of the present invention over previous compactors are the parallel outlet configuration which maximizes the space used, a single drive mechanism for plural outlets which simplifies the machine yet does not hamper its effectiveness, flexibility as to disposal into containers or bags, optional features such as manual override, indicator lights and emergency systems, and easy operation. Thus with only a single compacting ram twice as many containers can be filled thereby reducing by half the time between container replacements over other single ram compactors. In other words, the present invention provides twice the capacity with only one ram. This is especially important over weekends and holidays since it reduces the need for expensive manual labor to monitor the machines and to replace the filled containers with empty ones.

These and other features and advantages of the invention may be more completely understood from the following detailed description of the preferred embodiments of the invention with reference to the accompanying drawings.

DETAILED DESCRIPTION OF THE PREFERRED EMBODIMENTS

Figure 1:
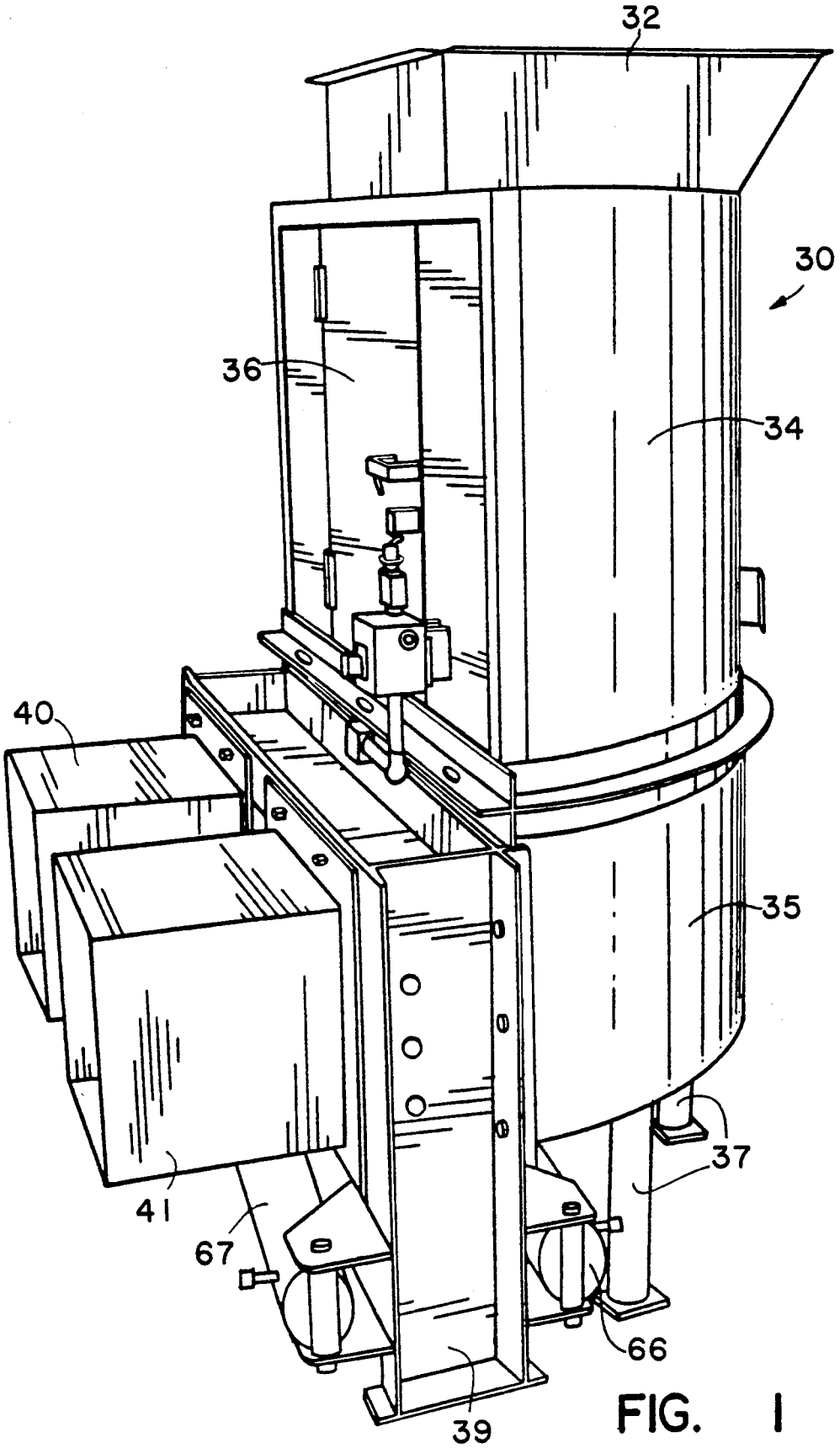
FIG. 1 is a perspective view of a trash compactor apparatus of the present invention.
Figure 2:
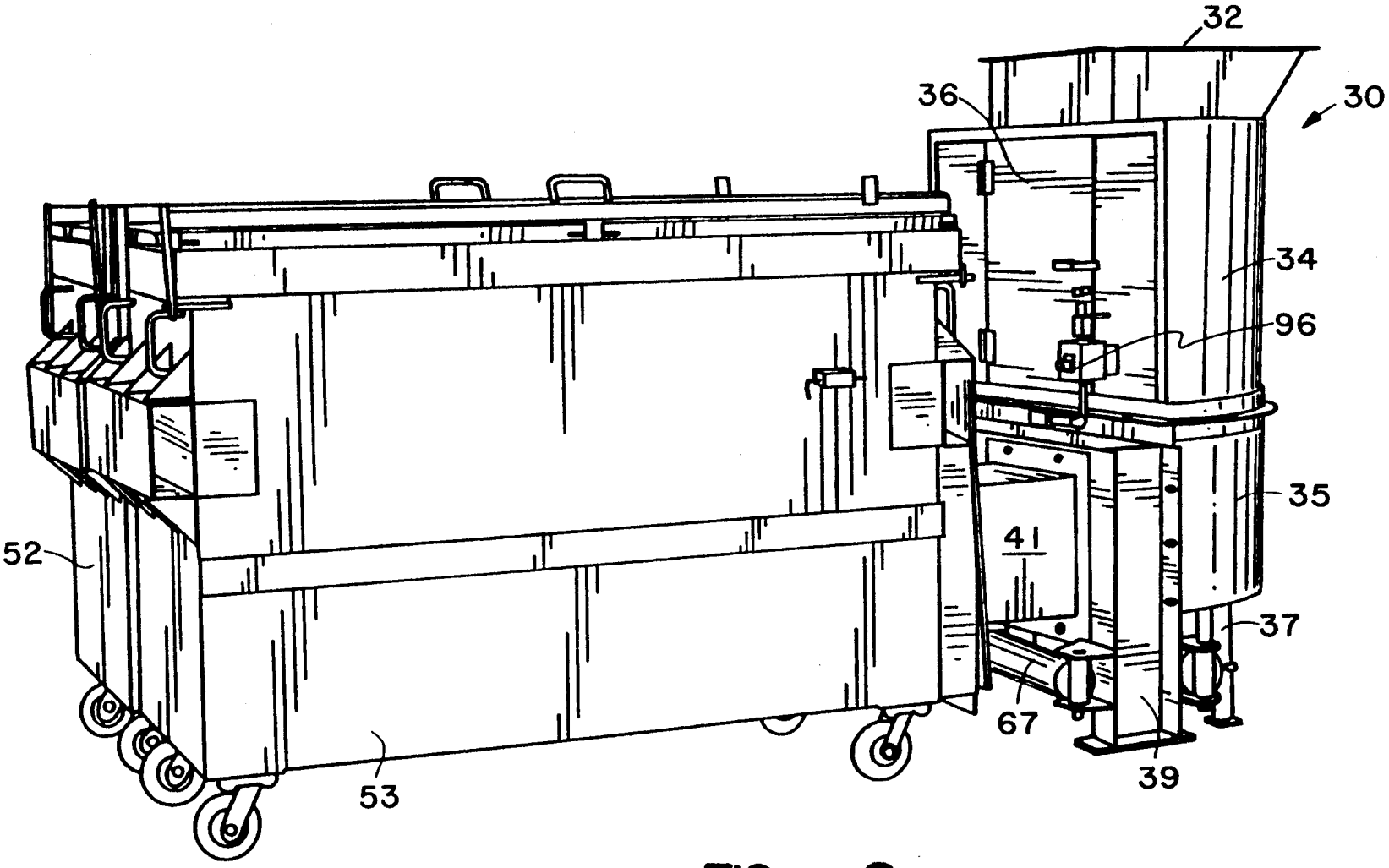
FIG. 2 is a perspective view of the trash compactor apparatus of FIG. 1 illustrated in use with two-yard garbage containers.
Figure 4A:
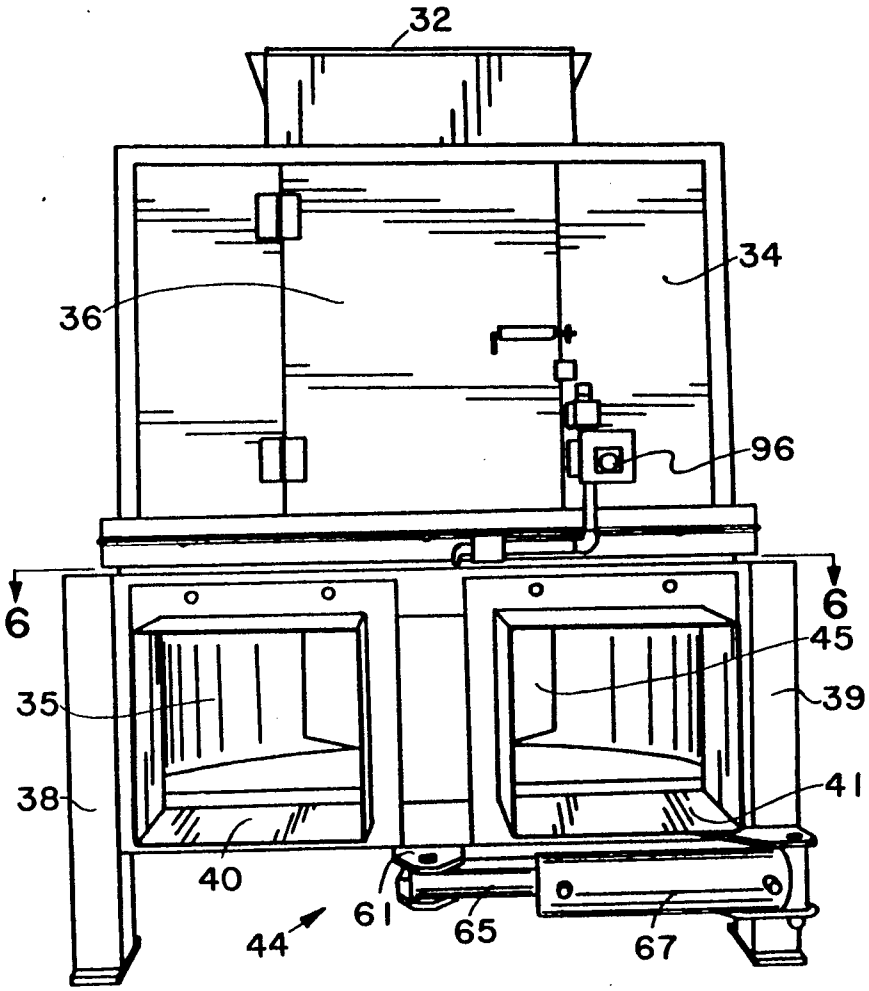
FIG. 4A is a front view of the trash compactor apparatus with the inspection door thereof in a closed position.
Figure 4B:
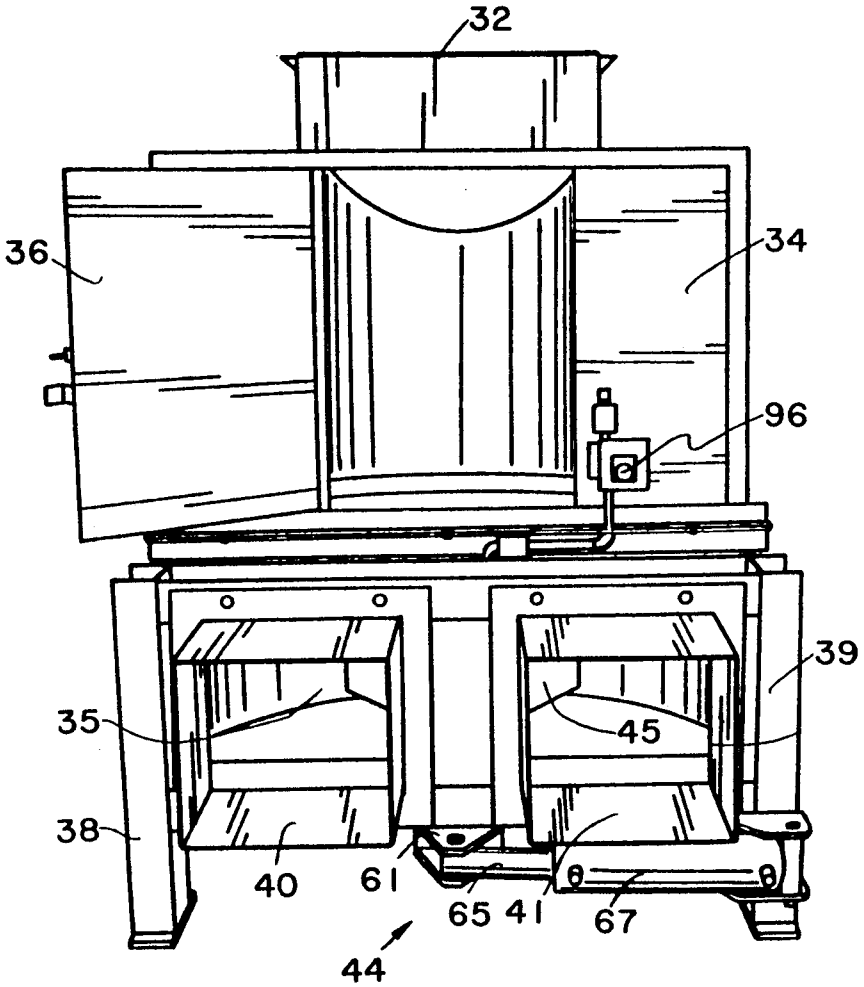
FIG. 4B is a view similar to that of FIG. 4A with the inspection door in an open position.
Figure 5:
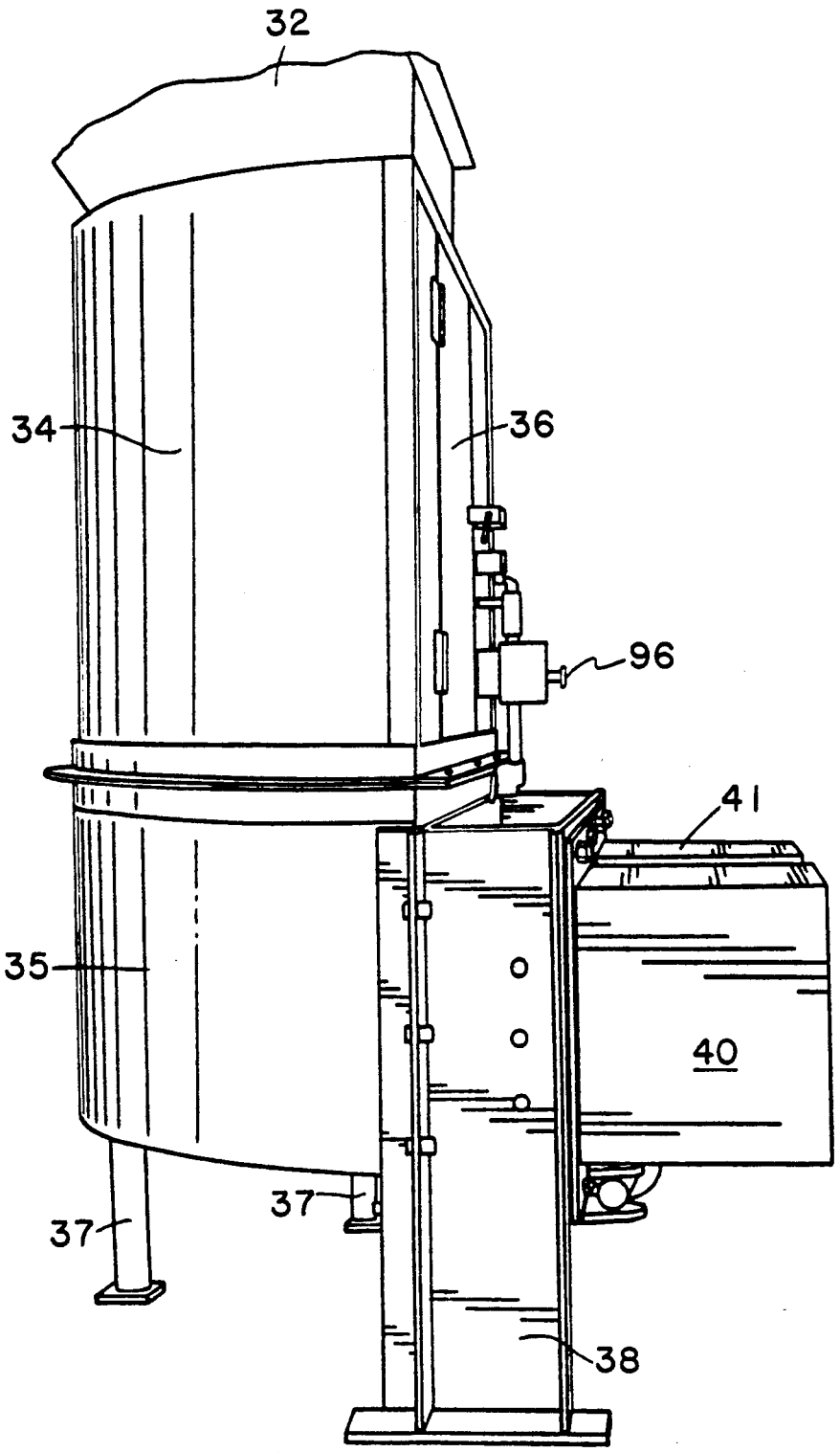
FIG. 5 is a side view of the trash compactor apparatus of FIG. 1.

Referring to FIG. 1, a compactor of the present invention is shown generally at 30 having an inlet 32 through which the material to be compacted enters the apparatus. The compactor 30 includes body 34, a ram chamber 35, and an inspection door 36 which opens to provide access to and visualization of the interior of the body and the ram chamber. Referring to FIGS. 4A, 4B and 5, the compactor 30 is supported above the ground by legs 37 generally along the rear of the ram chamber 35, and a pair of flanged supports 38 and 39 disposed at the diameter of the ram chamber. The flanged supports 38 and 39 support the ram chamber 35 and connect the ram chamber to tubular outlets 40 and 41. The ram chamber 35 is generally semi-circular in shape with the outlets 40 and 41 being disposed generally along the diameter thereof. The space underneath the ram chamber 35 formed by the legs 37 and flanged supports 38 and 39 defines a drive chamber 44, where any of the driving mechanisms (described later) are mounted. The flanged supports 38 and 39 also support the driving mechanism.

Figure 6:
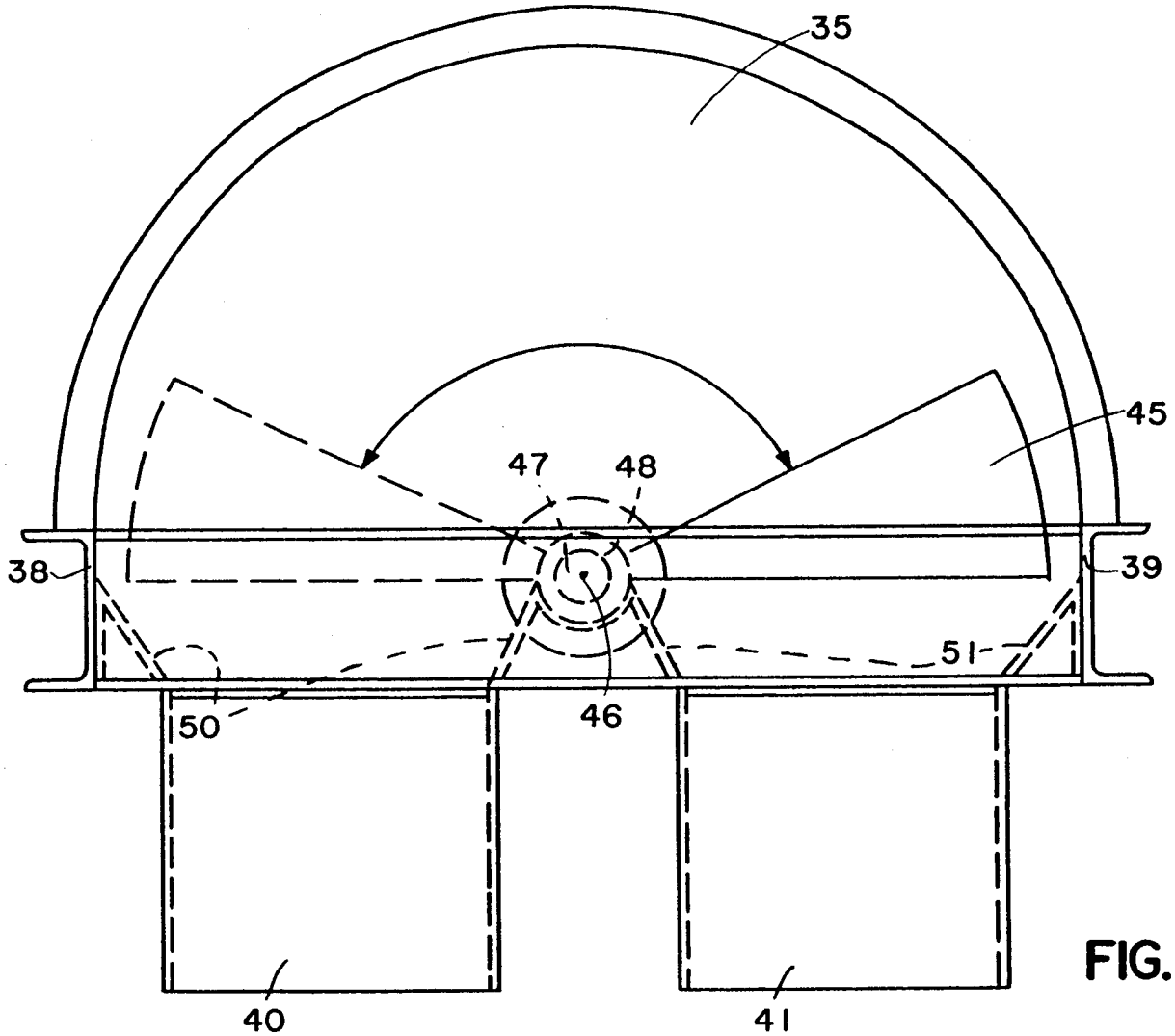
FIG. 6 is a cross sectional view taken along line 6—6 of FIG. 4A.

As can most clearly be seen in FIG. 6, the ram chamber 35 has a semicircular shape and the ram 45 is pie-shaped. The center point 46 of the diameter of the ram chamber 35 is also the center point of the imaginary circle of which the pie-shaped ram 45 is a portion. In other words, the ram 45 is connected to the ram chamber 35 at the center point 46 of the ram chamber diameter. The ram 45 is rigidly connected to a ram shaft 47, housed in a tubular housing 48 best shown in FIG. 10, which is driven by any of the driving mechanisms as described later. The center point 46 of the ram chamber diameter is also the center point of the circular cross section of the ram shaft 47. The center point 46 thus forms the driving point of the ram 45 since it is the point about which the ram shaft 47 rotates and the ram pivots. The ram 45 moves in a pivoting motion back and forth about the driving point similar to the motion of a windshield wiper. The side surfaces of the ram 45 contact the quantity of trash that is then within the ram chamber 35 and push the trash against reduction plate 50 (or 51) and into the container 52 (or 53) or directly out into the container 52 (or 53).

Figure 7:
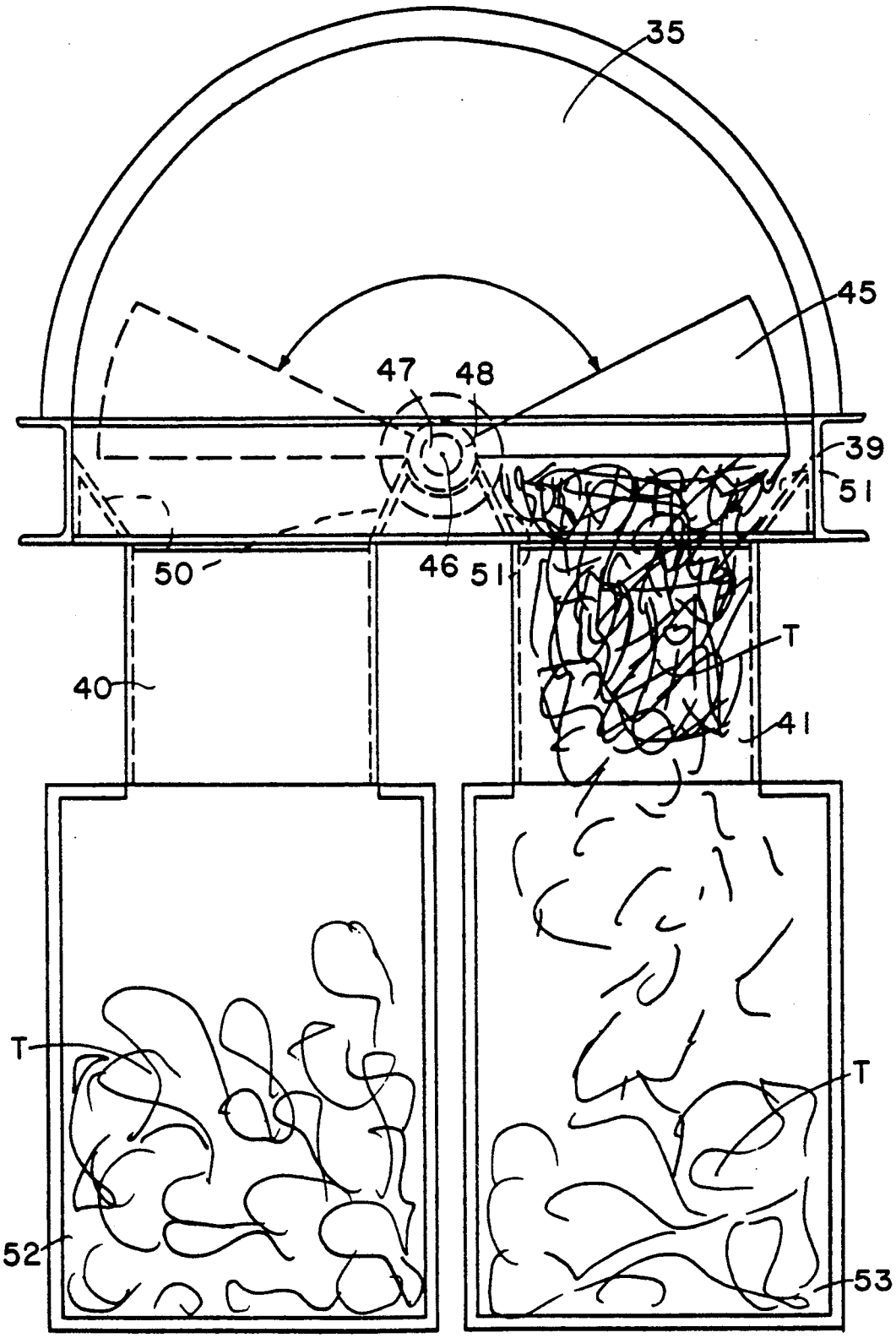
FIG. 7 is a cross sectional top view of the trash compactor apparatus as shown in FIG. 6 with rigid containers and showing trash being compacted against reduction plates at the outlets of the trash compactor apparatus.
Figure 8:
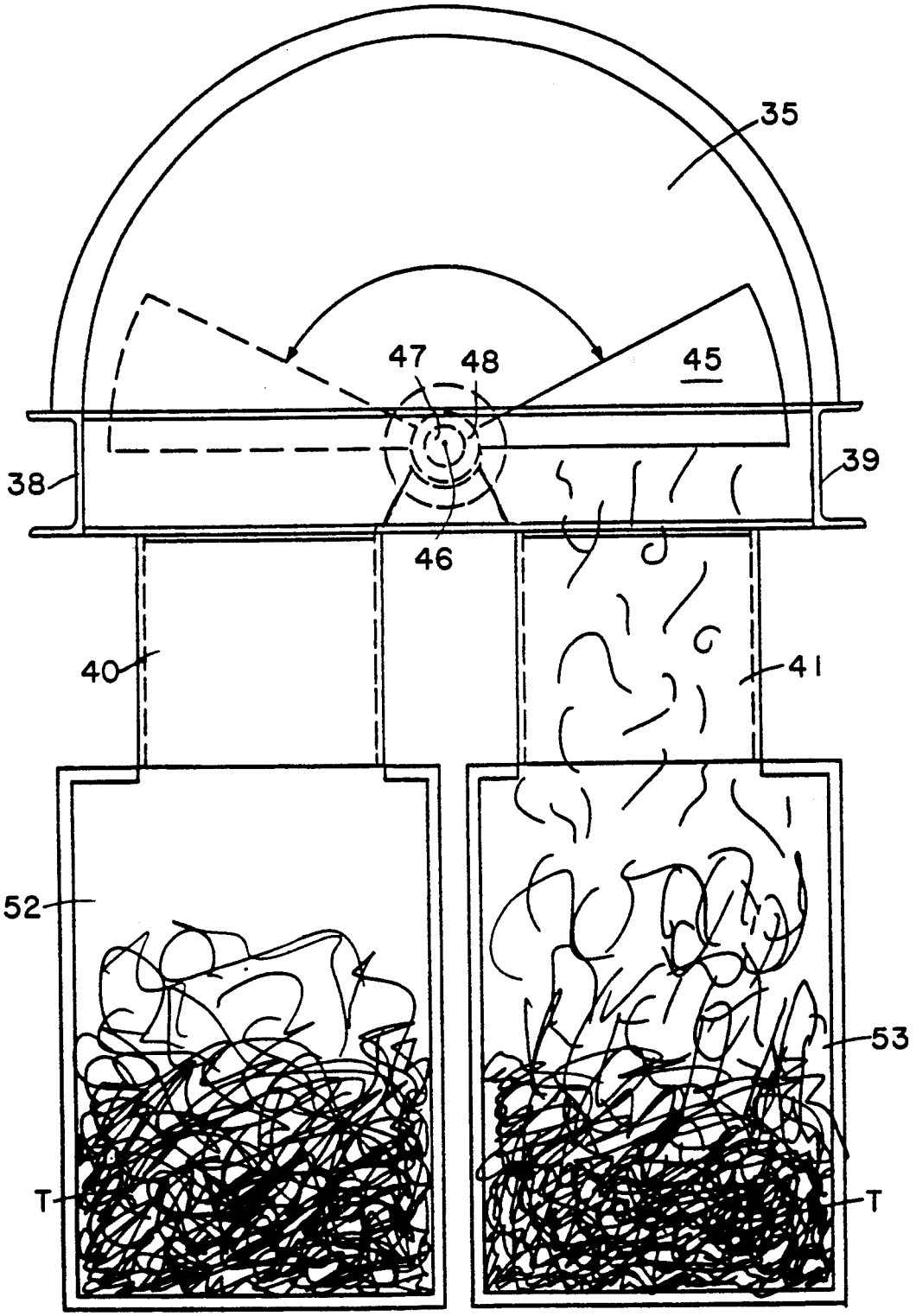
FIG. 8 is a cross sectional top view of the trash compactor apparatus of FIG. 6 with rigid containers and showing trash being pushed out by the ram and being compacted against the back wall of the container.
Figure 9:
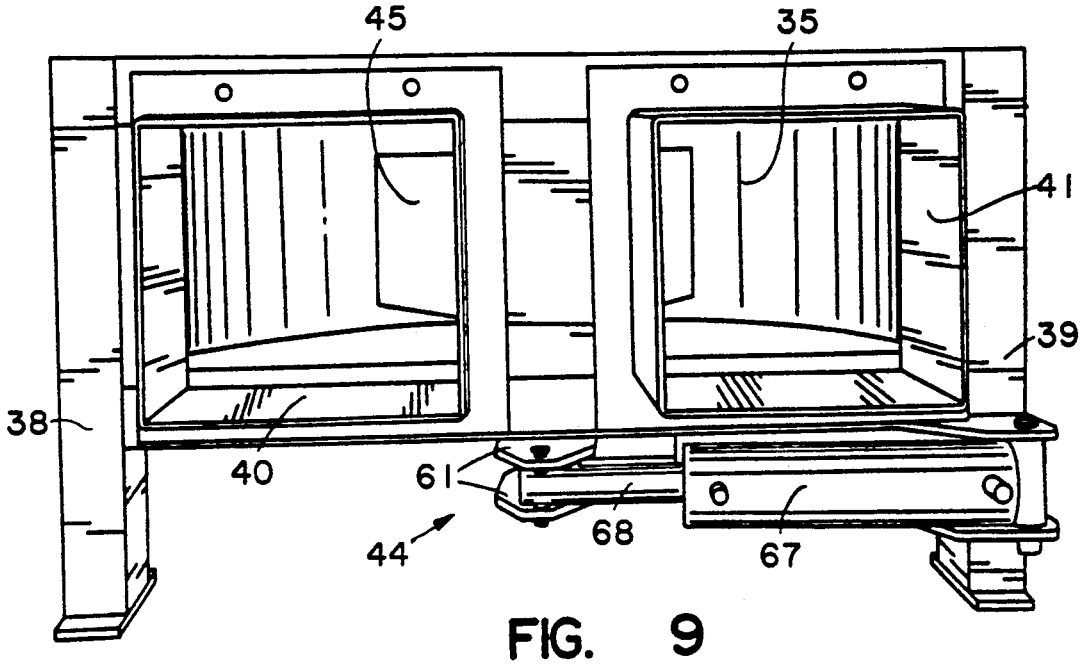
FIG. 9 is a close-up front view of the outlets of the apparatus of FIG. 1.

Referring to FIGS. 6–8, sets of the previously-mentioned reduction plates 50 and 51 can be used in communication with outlets 40 and 41, respectively. The reduction plates 50 and 51 are angled so as to act as funnels for the trash T, as best shown in FIG. 7. The reduction plates 50 and 51 reduce the exit area between the ram chamber 35 and the outlets 40 and 41 thus causing the trash T being pushed by the ram 45 to be compacted against them before and as it is being pushed into the awaiting containers. The angles of the reduction plates 50 and 51 determine the degree of compaction of the trash exiting the ram chamber 35. The preferred ratio of compaction of the compactor 30 is 4:1, which means that the volume of trash exiting the compactor is one fourth the volume before compaction. If the reduction plates 50 and 51 are used in the compactor 30, the exiting trash T can be pushed into either bags 55 conveyed on roller conveyors 56 and 57 or rigid containers 52 and 53 as shown in FIG. 7. If the reduction plates 50 and 51 are not used, the rigid containers 52 and 53 are preferably used to receive the trash T. The ram 45 acts much like a strong push broom, pushing the trash out of the ram chamber 35 with sufficient force to compact the trash T against the sides and bottoms of the containers 52 and 53, as best shown in FIG. 8.

The ram driving mechanism comprises the ram shaft 47 rigidly connected to the ram 45 at the center or driving point 46 and a driving means to move the ram shaft 47 and thus the ram about the driving point 46 so as to provide a pivotal compacting or wiping motion to the ram. The rigid connection between the ram shaft 47 and the ram 45 can be achieved by any means apparent to one of ordinary skill in the art. A preferred connection uses a shaft 47 having a key 49 which connects the ram 45 to the shaft, as best shown in FIGS. 12 and 14.

Figure 10:
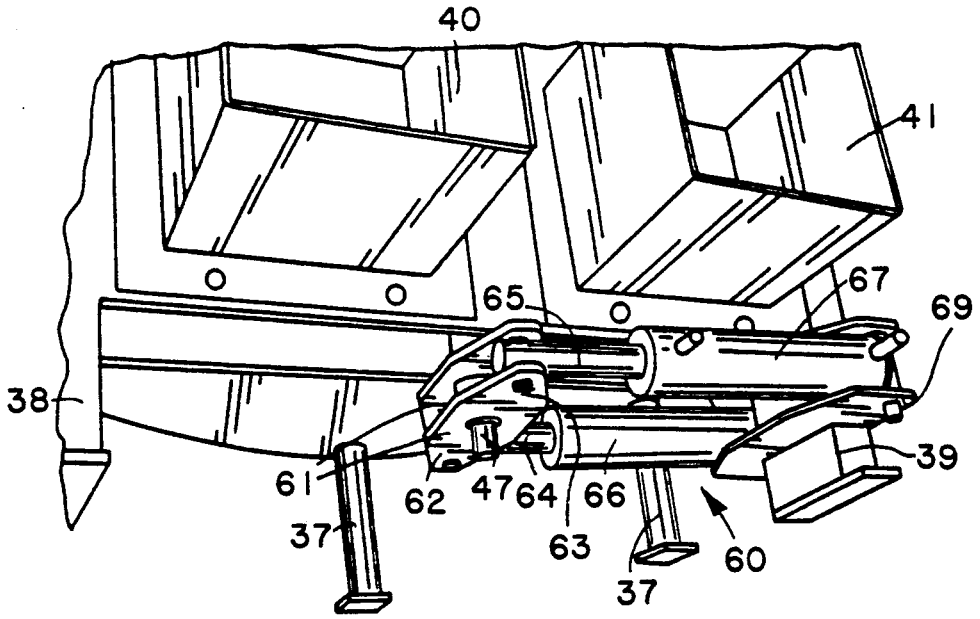
FIG. 10 is a bottom perspective view of the trash compactor apparatus of FIG. 1 and specifically of the driving mechanism of a first embodiment thereof of the invention.
Figure 11:
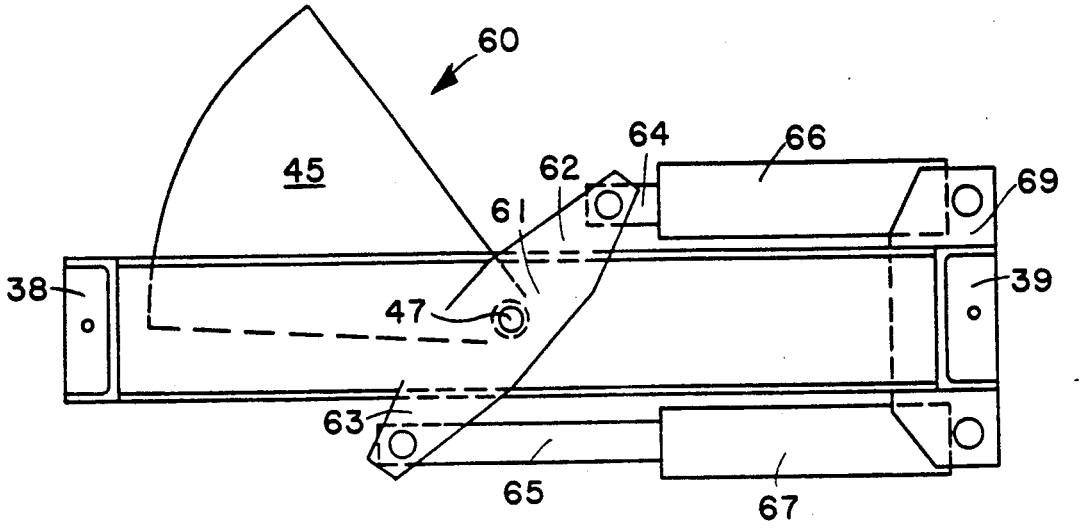
FIG. 11 is a schematic bottom view of the driving mechanism according to the first embodiment of FIG. 10.

The driving mechanism 60 of the first embodiment, as shown in FIGS. 10 and 11, comprises a yoke 61 having its center point vertically aligned with the driving point 46, and connected to the ram shaft 47. The ends 62 and 63 of the yoke 61 are coupled to pistons 64 and 65, respectively, of hydraulic cylinders 66 and 67, respectively. In the drive chamber 44, the cylinders 66 and 67 are mounted on a flanged support 39 using sandwich plates 69 between which the cylinders are held. Power to the cylinders 66 and 67 can be supplied from a conventional hydraulic source (not shown). The piston-cylinders 64, 66 and 65, 67 are mounted so they are parallel to one another and are operated so that when one piston is extended the other is retracted. Alternate extension and retraction of the two-piston-cylinders 64, 66 and 65, 67 imparts a predetermined degree of rotation to the ram shaft 47 in one direction then back in the other direction. Since the ram shaft 47 is rigidly connected to the ram 45, rotation of the ram shaft results in rotational movement of the ram about the same driving point 46 as the ram shaft. The back and forth partial circular motion of the ram 45 about the driving point 46 provides the compacting motion necessary for the side surfaces of the ram 45 to make contact with any trash 70 in the ram chamber 35. The outlets 40 and 41 are positioned on either side of the ram shaft 47 so that alternate amounts of trash exit from the outlets 40 and 41 with each compacting motion of the ram 45.

Figure 12:
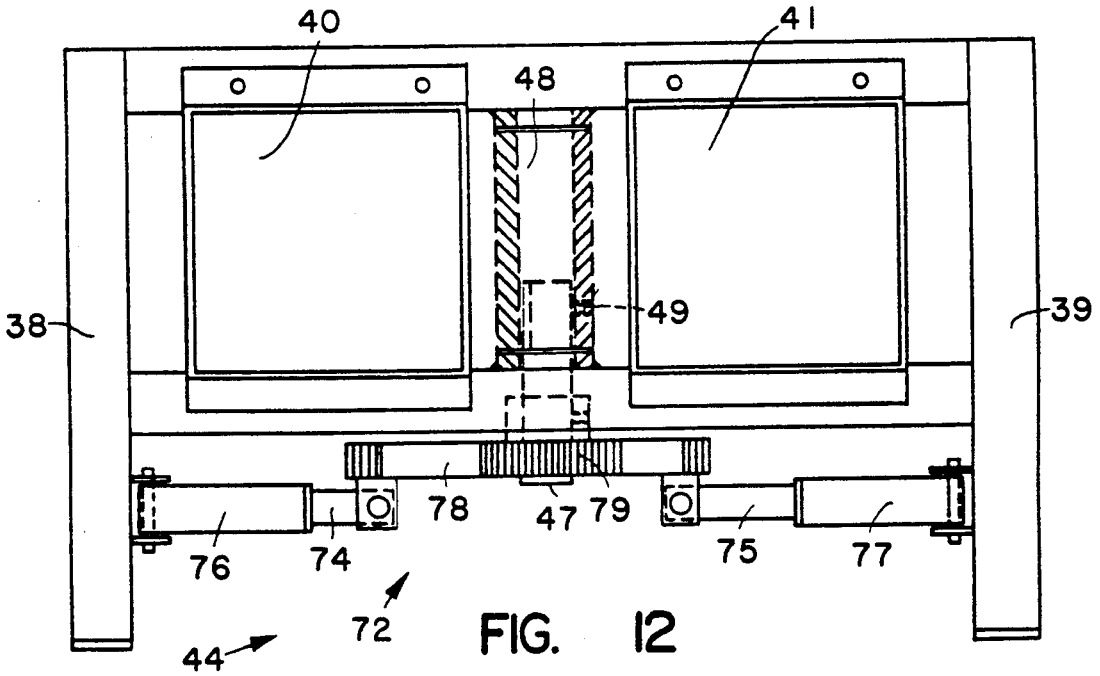
FIG. 12 is a front view of the driving mechanism of a second embodiment of the invention.
Figure 13:
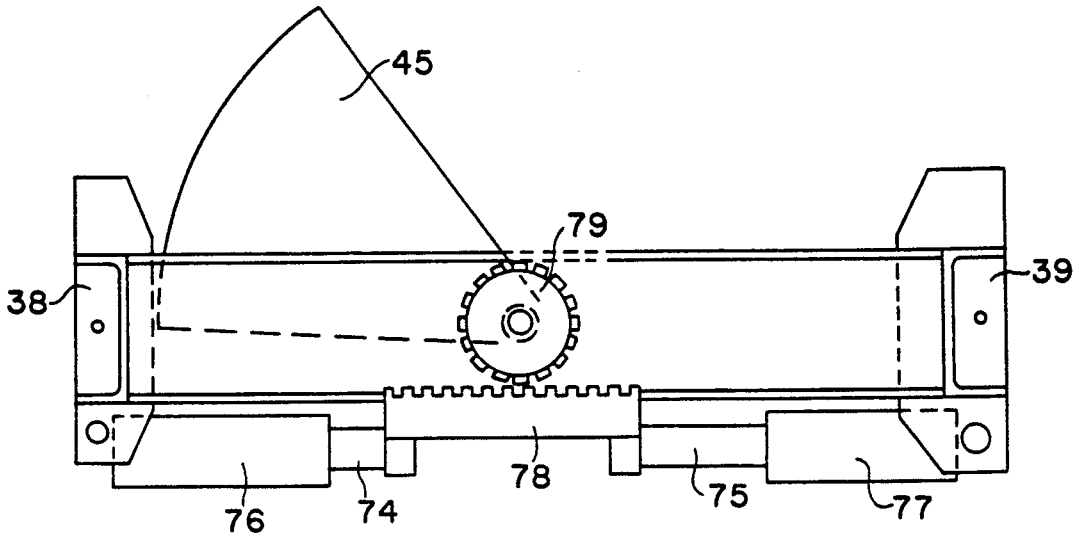
FIG. 13 is a schematic bottom view of the driving mechanism of the second embodiment of FIG. 10.

The driving mechanism 72 of the second embodiment of the invention, as best illustrated in FIGS. 12 and 13, comprises (1) a pair of hydraulic pistons 74 and 75 and their respective cylinders 76 and 77, the piston-cylinders being substantially in line with one another, (2) a gear rack 78 having its ends connected to the pistons 74 and 75 and (3) a pinion or spur gear 79, mated to the gear rack 78, which drives the ram shaft 47. Again, a conventional hydraulic power source (not shown) can be used for powering the piston-cylinders. In the drive chamber 44, the piston-cylinder 74, 76 is mounted to flanged support 38 and piston-cylinder 75, 77 is mounted to the opposite flanged support 39. Thus, the longitudinal axes of the pistons and cylinders are in line. The gear rack 78 has each of its ends connected to one of the pistons 74 and 75. The piston-cylinders are operated so that when one piston is extended the other is retracted. This alternate extension and retraction of the two piston-cylinders imparts a linear motion to the gear rack 78. Linear movement of the gear rack 78 in turn causes a rotational movement of the mated spur gear 79 about its center point which coincides with the driving point 46. Since the ram shaft 47 is connected to the spur gear 79, the nmotion of the spur gear is thereby imparted to the ram shaft to provide the back and forth compacting motion to the ram 45.

Figure 14:
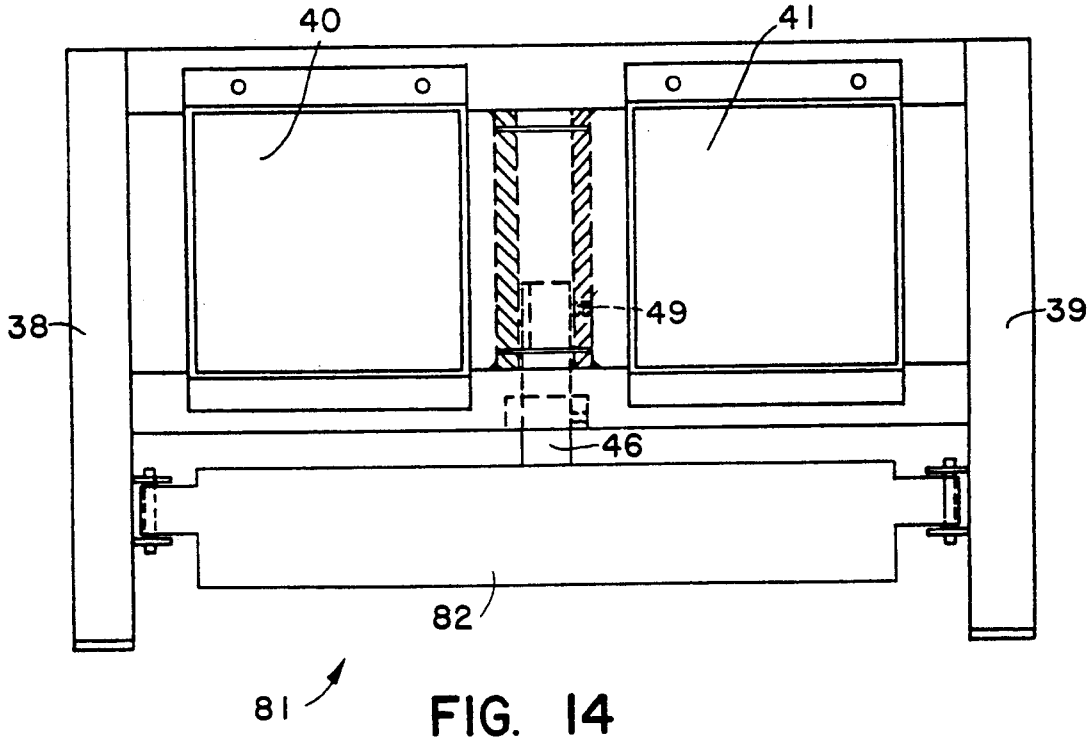
FIG. 14 is a schematic view of the driving mechanism of a third embodiment of the invention.

In the driving mechanism 81 of the third embodiment of the invention, schematically illustrated in FIG. 14, a conventional power source can be directly mounted in the drive chamber 44. The output shaft of a gear reduction motor 82 acts as the ram shaft 47. The motor 82 contains a means for reversing the rotation of the ram shaft 47, as would be understood by those skilled in the art, a predetermined amount resulting in pivotal movement of the ram 45 about the driving point 46.

As would be appreciated by those skilled in the art any suitable means of driving the ram shaft 47 and ram 45 are within the scope of the present invention.

Figure 3:
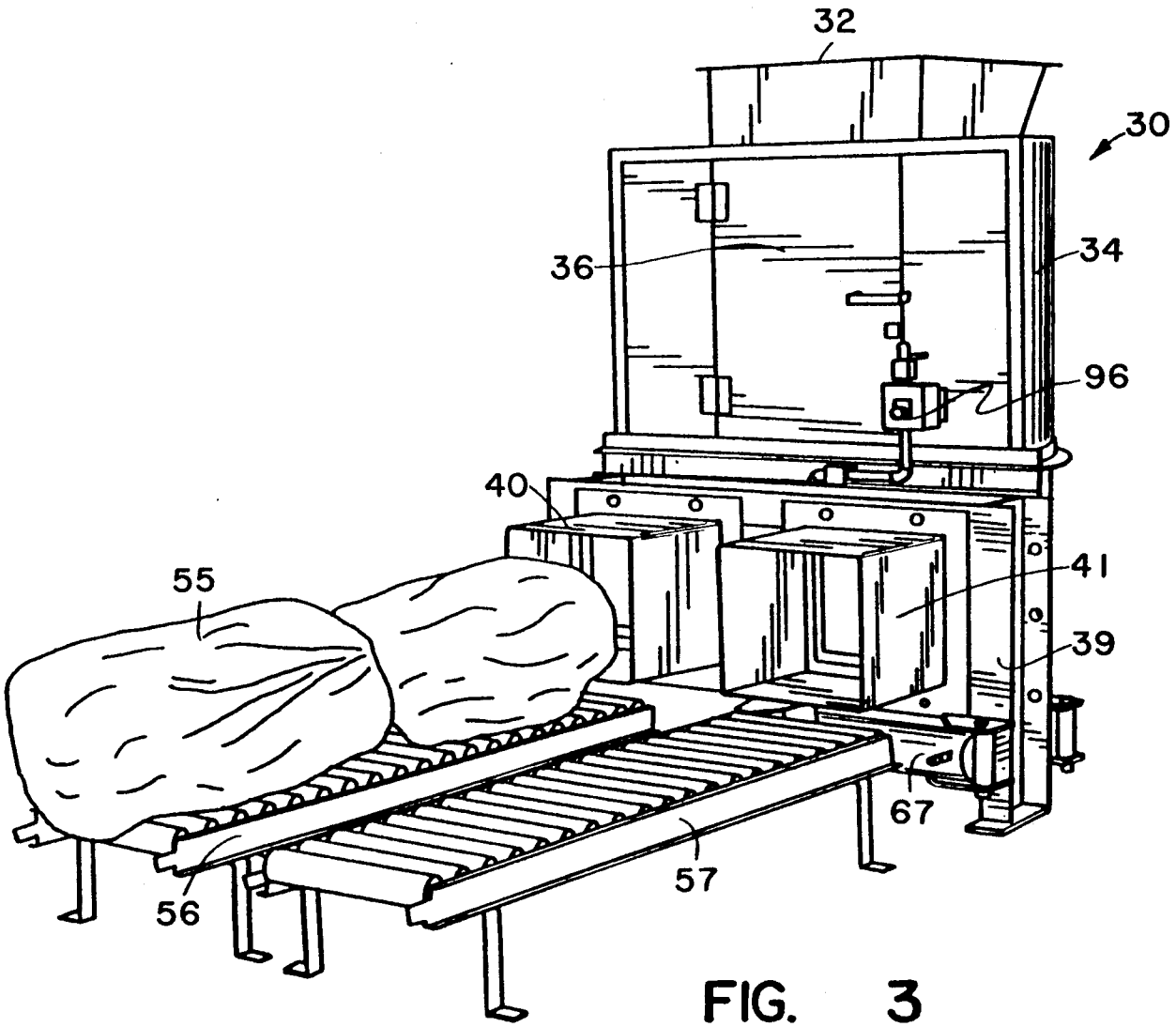
FIG. 3 is a perspective view of the trash compactor apparatus of FIG. 1 illustrated in use with roller conveyors and bags of trash.
Figure 15:
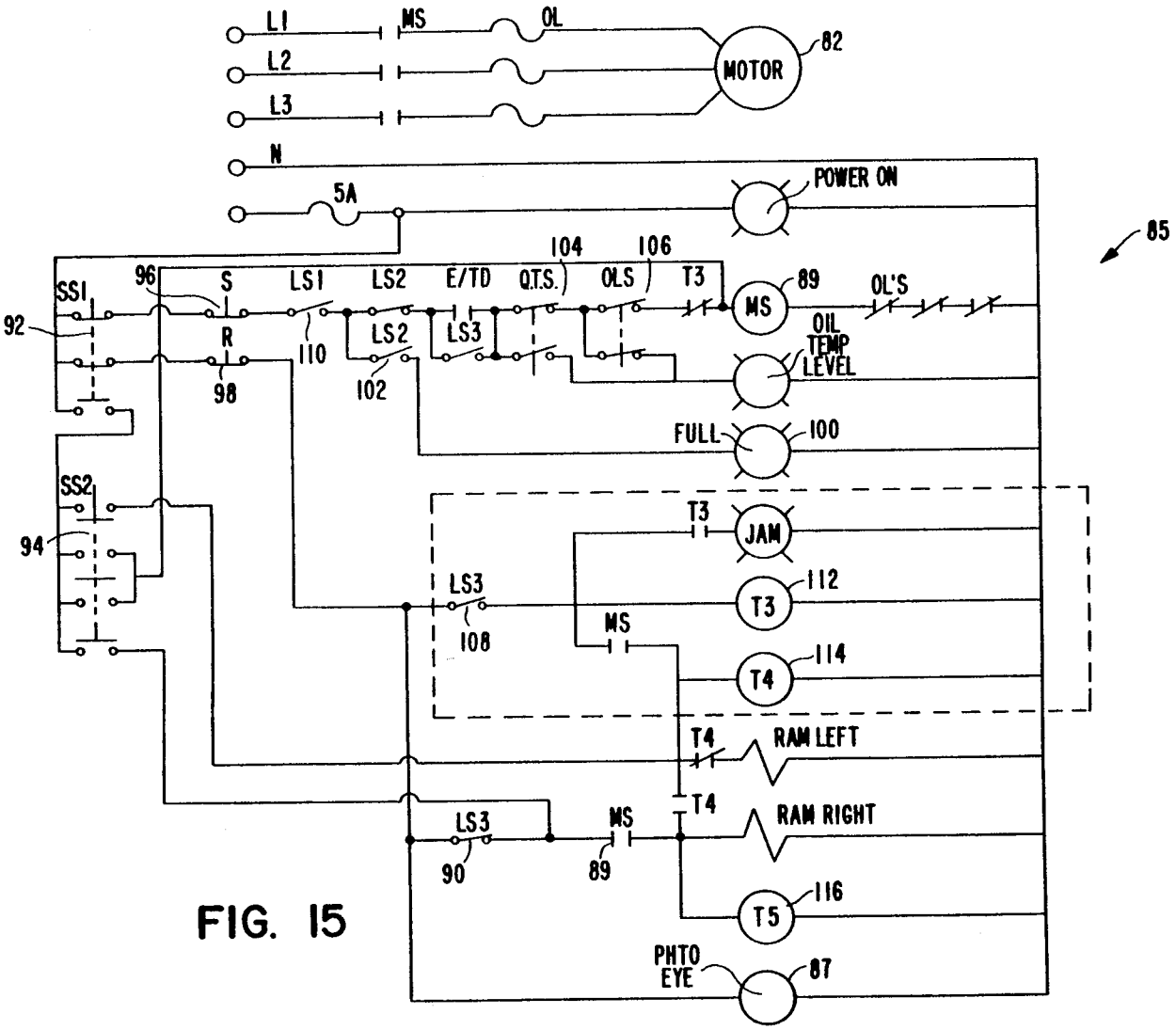
FIG. 15 is an electronic control circuit diagram for the trash compactor apparatus of FIG. 1.

Referring to FIG. 15, an electronic control circuit shown generally at 85 is illustrated which controls the actions of the ram driving mechanisms. For ease of explanation, the control circuit 85 shown in FIG. 15 is drawn toward the third embodiment of the driving mechanism, that is, the gear reduction motor 82. Of course a similar control circuit is used for the other mechanisms, with the main differences being the power sources, as would be apparent to those skilled in the art. A sensing device such as a photo-electric eye 87 is placed in the compactor body 34 with its beam traversing the inside of the body. When the beam of photoeye 87 is interrupted by incoming trash T from the inlet 32, a normally open switch 90 is closed and the ram 45 is moved either to the left or right. The control circuit 85 has features such as a key operated automatic or manual switch 92, a manually operated switch 94 which can be used to move the ram to the left or right to dislodge any jammed material, an emergency stop switch 96, which is located near the door 36 as shown in FIG. 3, and a jam reset switch 98.

Any number of indicator lights may also be added to facilitate use of the compactor 30 activated by the appropriate sensors. Examples of optional indicators and sensors are a full indicator 100 activated by switch 102. Any number of overrides can be built into the control circuit with appropriate sensors and transducers. An example is a manual emergency stop override 96 which would open the control circuit regardless of the condition of the beam of the photoeye 87, and other emergency stop overrides sensitive to other operating conditions such as temperature and fluid levels, such as an oil temperature switch 104 and an oil level switch 106. A further override is the switch 110 in communication with the inspection door 36; that is, when the door is opened, the ram 45 is automatically caused to stop moving. Another example is to build in an override to stop the ram 45 if a jam is sensed by suitable transducers which close switch 108. Additional control features could be added to the compactor 30 such as an automatic fire extinguishing system and an insecticide system both controlled by the control circuit and triggered by appropriate transducers and switches. Various timers 112, 114 and 116 can be used in the control circuit for controlling conditions such as jam delays and insecticide system delays.

The operation of the compactor 30 to fill the containers 52 and 53 or bags 55 is aided by the control circuit which operates the ram 45 when the beam of the photoeye 87 is broken. The ram 45 is driven back and forth in a pivotal compacting motion which compacts the trash T and pushes it out of the ram chamber 35. When the beam of the photoeye 87 is clear, the ram 45 stops and comes to rest near either of the outlets 40, 41. The next time the beam of the photoeye 87 is broken the same movement of the ram 45 ensues, and over time, the containers 52, 53 or bags 55 on the two outlets 40, 41 are filled at about the same rate since the ram 45 alternates pushing the trash T out between the two outlets.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited only by the claims appended hereto.

I claim:

1. An apparatus for compacting relatively loose material, said apparatus comprising:

an inlet for receiving the relatively loose material to be compacted;

a ram chamber communicating with said inlet for containing the material from said inlet to be compacted;

a ram disposed in said ram chamber and movable therein so as to make contact with the material therein;

driving means for pivotably driving said ram about a vertical axis and in a compacting motion such that said ram contacts the material in said ram chamber; and a plurality of outlets in communication with said ram chamber and through which the material exits said ram chamber by the motion of said ram.

2. The apparatus of claim 1, further comprising reduction plates disposed in said ram chamber adjacent each of said outlets and against which said ram compacts the material such that the volume of the material exiting said outlets is less than the volume of material prior to compaction thereof by said ram.

3. The apparatus of claim 2, further comprising a rigid container disposed at each of said outlets for receiving material from said ram chamber.

4. The apparatus of claim 3, wherein said rigid containers are two-yard garbage containers.

5. The apparatus of claim 4, wherein said ram chamber is semi-circular in cross section with said outlets disposed along its diameter, top and bottom surfaces of said ram are in the shape of a portion of a circle, side surfaces of said ram are vertical, and said ram is connected to said driving means at a driving point disposed at the center of the diameter of said ram chamber the center of the portion of said circle of the ram.

6. The apparatus of claim 5, further comprising a drive chamber containing said driving means and disposed underneath said ram chamber.

7. The apparatus of claim 6, wherein said driving means is disposed in said drive chamber, and comprises a tubular ram shaft housing containing a ram shaft extending vertically through the driving point of said ram chamber such that said ram is rigidly connected to said ram shaft.

8. The apparatus of claim 7, wherein said driving means further comprises:

a pair of hydraulic cylinders and pistons, said cylinders being connected to the exterior of a side of said ram chamber such that said cylinders and their respective pistons are parallel to each other; and a yoke having ends coupled to each of said pistons and the center point of said yoke which is vertically aligned with said driving point, said yoke being rigidly coupled to said ram shaft which is rigidly connected to said ram at the center point of said yoke, such that said pistons reciprocate alternately to move said yoke about the center point thereof and thereby providing pivotable movement of said ram about the driving point.

9. The apparatus of claim 7, wherein said driving means further comprises:

a pair of hydraulic cylinders and pistons disposed in said drive chamber such that said hydraulic cylinders and pistons have their longitudinal axes substantially in line;

a gear rack disposed substantially between said hydraulic cylinders and rigidly connected to said pistons; and a spur gear whose center point is vertically aligned with the driving point mated to said gear rack and rigidly connected to said ram shaft which is rigidly connected to said ram such that alternate movement of said pistons in and out of their respective said cylinders provides linear movement to said gear rack thereby rotating said spur gear and said ram shaft and providing pivotable movement of said ram about the driving point in the ram chamber.

10. The apparatus of claim 7, wherein said driving means further comprises a gear reduction motor disposed in said drive chamber and operatively connected to said ram shaft so as to provide back and forth pivotal motion of said ram about the driving point.

11. The apparatus of claim 2, wherein said ram pushes the compacted material through said outlets and into bags of a bag cartridge disposed at each of said outlets.

12. The apparatus of claim 11, further comprising a roller conveyor disposed at each of said outlets for conveying bags of compacted material away from said outlets, and wherein said outlets are aligned with tops of said roller conveyors.

13. The apparatus of claim 1, further comprising a rigid container disposed at each of said outlets for receiving the material from said ram chamber, and wherein said ram pushes the material out of said ram chamber through said outlets such that the material is compacted against walls of said rigid containers.

14. The apparatus of claim 13, wherein said rigid containers are two-yard garbage containers.

15. The apparatus of claim 1, wherein said ram pushes the compacted material through said outlets into bags of a bag cartridge disposed at each of said outlets, further comprising a roller conveyor disposed at each of said outlets for conveying bags of compacted material, and wherein said outlets are aligned with tops of said roller conveyors.

16. The apparatus of claim 1, wherein said inlet is an upwardly opening hopper for receiving the relatively loose material from above.

17. The apparatus of claim 1, further comprising an electric photoeye which senses when material is fed into said inlet, and a switch connected to said photoeye and which activates said ram when the beam of said photoeye is interrupted, and which stops said ram when the beam of said photoeye is clear.

18. The apparatus of claim 1, further comprising an inspection door disposed above said outlets for accessing said ram chamber.

19. The apparatus of claim 1, wherein said ram chamber is semi-circular in cross section with said outlets disposed along its diameter, top and bottom surfaces of said ram are in the shape of a portion of a circle, surfaces of said ram are vertical, and said ram is connected to said driving means at a driving point disposed at the center of the diameter of said ram chamber and the center of said portion of the circle of the ram.

20. The apparatus of claim 19, further comprising a drive chamber containing said driving means and disposed underneath said ram chamber.

21. The apparatus of claim 20, wherein said driving means comprises a tubular ram shaft housing containing a ram shaft extending vertically through said driving point of said ram chamber such that said ram is rigidly connected to said ram shaft.

22. The apparatus of claim 21, wherein said driving means further comprises:

a pair of hydraulic cylinders and pistons, said cylinders being connected to the exterior of a side of said ram chamber such that said cylinders and their respective said pistons are parallel to each other; and a yoke having ends coupled to each of said pistons and a center point of said yoke which is vertically aligned with the driving point, said yoke being rigidly coupled to said ram shaft at the center point of said yoke which is rigidly connected to said ram such that said pistons reciprocate alternately to move said yoke about the center point, thereby providing pivotable movement of said ram about the driving point.

23. The apparatus of claim 21, wherein said driving means further comprises:

two hydraulic cylinders and pistons disposed in said drive chamber such that said hydraulic cylinders and pistons have their longitudinal axes substantially in line;

a gear rack disposed substantially between said hydraulic cylinders and rigidly connected to said pistons; and a spur gear, whose center point is vertically aligned with said driving point, mated to said gear rack and rigidly connected to said ram shaft which is rigidly connected to said ram such that alternate movement of said pistons in and out of respective said cylinders provides linear movement to said gear rack thereby rotating said spur gear and said ram shaft and thereby providing pivotable movement of said ram about the driving point in said ram chamber.

24. The apparatus of claim 21, wherein said driving means further comprises a gear reduction motor disposed in said drive chamber and operatively connected to said ram shaft so as to provide back and forth pivotal motion of said ram about the driving point.

25. The apparatus of claim 1, wherein the relatively loose material comprises multi-residential unit trash.

26. The apparatus of claim 25, wherein said plurality of outlets comprises first and second outlets, and said ram, through the pivotal driving motion of said driving means, pushes quantities of trash in said ram chamber from said inlet alternately out said first and second outlets.

27. A trash compactor comprising:

a trash inlet;

a chamber into which trash from said trash inlet is fed;

first and second trash outlets exiting from said chamber; and a pivotal ram disposed in said chamber and whose pivotal motion pushes alternate quantities of trash in said chamber from said trash inlet in a compacting motion alternately out said first and second trash outlets.

28. The trash compactor of claim 27, further comprising a first set of reduction plates disposed in said chamber adjacent said first outlet and a second set of reduction plates disposed in said chamber adjacent said second outlet, said ram compacting the trash against said first and seconds sets of reduction plates such that the volume of the trash exiting said outlets is less than the volume of the trash prior to compaction, a first rigid container disposed at said first outlet for receiving the trash compacted against said first set of reduction plates from said first outlet, and a second rigid container disposed at said second outlet for receiving the trash compacted against said second set of reduction plates from said second outlet.

29. The trash compactor of claim 28, further comprising a ram driving mechanism disposed underneath said chamber, said ram driving mechanism comprising a tubular ram shaft housing containing a ram shaft extending vertically through a driving point of said chamber such that said ram is rigidly connected to said ram shaft, said chamber is semi-circular in cross section with said outlets disposed along its diameter, top and bottom surfaces of said ram are in the shape of a portion of a circle, and side surfaces of said ram are vertical, and said ram is connected to said ram driving mechanism at the driving point disposed at the center of the diameter of the ram chamber and the center of said portion of said circle of the ram.

30. The trash compactor of claim 25, further comprising a roller conveyor disposed at each of said outlets for conveying bags of trash, wherein said outlets are aligned with tops of said roller conveyors, and wherein said ram pushes the trash through said outlets into bags of a bag cartridge disposed at each of said outlets.

31. The trash compactor of claim 27, further comprising a rigid container disposed at each of said outlets for receiving the trash from said chamber, and wherein said ram pushes the trash out of said chamber through said outlets such that the trash is compacted against walls of said rigid containers.

32. The trash compactor of claim 27, wherein said inlet is an upwardly opening hopper for receiving therein trash from above.

33. The trash compactor of claim 27, further comprising an electric photoeye which senses when trash is fed into said inlet, and a switch connected to said photoeye and which activates said ram when the beam of said photoeye is interrupted by the trash, and which stops said ram when the beam of said photoeye is clear.

34. The trash compactor of claim 29, wherein said ram driving mechanism further comprises:

a pair of hydraulic cylinders and pistons, said cylinders being connected to the exterior of a side of said chamber such that said cylinders and their respective pistons are parallel to each other; and a yoke having ends coupled to each of said pistons and the center point of said yoke which is vertically aligned with the driving point, said yoke being rigidly coupled to said ram shaft which is rigidly connected to said ram at the center point of said yoke, such that said pistons reciprocate alternately to move said yoke about the center point of said yoke thereby providing pivotable movement of said ram about the driving point.

35. The trash compactor of claim 29, wherein said ram driving mechanism further comprises:

two hydraulic cylinders and pistons disposed under said chamber such that said hydraulic cylinders and pistons have their longitudinal axes substantially in line;

a gear rack disposed between said hydraulic cylinders and rigidly connected to said pistons; and a spur gear, whose center point is vertically aligned with the driving point mated to said gear rack and rigidly connected to said ram shaft which is rigidly connected to said ram such that alternate movement of said pistons in and out of their respective said cylinders provides linear movement to said gear rack thereby rotating said spur gear and said ram shaft, and providing pivotable movement of said ram about the driving in said chamber.

36. A trash compacting method, comprising the steps of:

providing a chamber having a chamber inlet and first and second chamber outlets and a ram in the chamber;

feeding through the chamber inlet a first quantity of trash into the chamber;

pivoting the ram in a first direction and thereby pushing in a compacting motion the first quantity of trash out the first chamber outlet and compacted into a first container;

after said first quantity feeding step, feeding through the chamber inlet a second quantity of trash into the chamber; and after said first direction pivoting step, pivoting the ram in a second direction and thereby pushing in a compacting motion the second quantity of trash out the second chamber outlet and compacted into a second container.

37. The method of claim 36, further comprising:

generating a signal indicating the presence of trash in the chamber; and activating the ram to alternately move in one of the first or second directions in response to the signal for successive feedings of trash into the chamber such that the first and second containers are alternately filled with quantities of compacted trash.

38. The method of claim 36, further comprising repeating said feeding and pivoting steps until both of the first and second containers are full of compacted trash.

39. The method of claim 38, further comprising, after said repeating step, removing the trash filled first and second containers and replacing them with empty first and second containers.

* * * * *